US006382860B1

(12) United States Patent
Kim

(10) Patent No.: US 6,382,860 B1
(45) Date of Patent: May 7, 2002

(54) SAFETY KNOCK-TYPE WRITING UTENSIL

(75) Inventor: Je-Won Kim, Dong-gu (KR)

(73) Assignee: Dong-A Pencil Co., Ltd., Seoul (KR)

( * ) Notice: Subject to any disclaimer, the term of this patent is extended or adjusted under 35 U.S.C. 154(b) by 0 days.

(21) Appl. No.: 09/613,420

(22) Filed: Jul. 10, 2000

(30) Foreign Application Priority Data

May 10, 2000 (KR) ..... 00-25052

(51) Int. Cl.[7] ..... B43K 24/02
(52) U.S. Cl. ..... 401/104; 401/110; 401/111
(58) Field of Search ..... 401/104, 105, 401/106, 99, 109, 110, 111

(56) References Cited

U.S. PATENT DOCUMENTS 1,583,718 A * 5/1926 Hudson ..... 401/104
2,809,609 A * 10/1957 Clary et al. ..... 401/105
4,702,634 A * 10/1987 Herold et al. ..... 401/104
5,152,626 A * 10/1992 Eppler ..... 401/104

* cited by examiner

*Primary Examiner*—David J. Walczak
(74) *Attorney, Agent, or Firm*—Shanks & Herbert

(57) ABSTRACT

A safety knock-type writing utensil capable of maintaining an outer shell in a relatively thin thickness and making a length of a writing lead substantially long by the change of the locking position, thereby allowing a large amount of ink to be stored therein. The safety knock-type writing utensil includes: an outer shell; a clip; a writing lead; an elastic member installed in the interior of the outer shell; a moving member movably inserted in the top portion of the outer shell and having a predetermined length of safety protrusion inserted into the interior of the moving groove in a length direction thereof, the safety protrusion having a fixed projection extruding outwardly to be locked on the locking projection of the clip; a pressing member having a pressing protrusion inserted movably into the interior of the moving member at the part of the lower portion thereof and being contacted with the upper surface of the moving member at the outer peripheral surface of the center portion thereof; and a knock member inserted movably into the moving member, for maintaining the advanced state of the writing lead if the pressing member is pressed once in the state where the fixed projection of the moving member is locked into the locking projection of the clip, and for operating the writing lead in a backward direction by the elastic force of the elastic member if the pressing member is repressed.

7 Claims, 5 Drawing Sheets

SAFETY KNOCK-TYPE WRITING UTENSIL

BACKGROUND OF THE INVENTION

1. Field of the Invention

The present invention relates to a safety knock-type writing utensil capable of automatically changing a writing lead which has been exposed for writing into a keeping state where the writing lead is drawn, if the hook of a clip fixed in the upper portion thereof is lifted, for the purpose of sticking the writing utensil in the collar of a coat or the upper strip of a pocket, thereby preventing the leakage of ink caused due to the contact of a tip of the writing lead with on the cloth of the collar of the coat or the upper strip of the pocket and more particularly, to a safety knock-type writing utensil capable of providing a thin thickness of an outer shell and making the length of the writing lead substantially long by the change of a locking position, thereby allowing a large amount of ink to be stored into the writing lead.

2. Description of the Related Art

Well-known examples of the writing utensils are pencils, ball pen, sign pens or the like, and examples similar thereto are covering utensils for covering a correcting liquid.

Generally, the writing utensil is classified into a fixed type writing utensil which is adapted to fix a writing lead in an outer shell in the state where the writing lead is exposed at the tip thereof and cover the exposed tip of the writing lead with a cap and a knock-type writing utensil which is adapted to assemble the writing lead in the outer shell in a movable manner and expose or insert the tip of the writing lead to the outside of the outer shell or into the inside of the outer shell in accordance with the operation of a pressing member.

The conventional knock-type writing utensil is configured in such a manner that if the pressing member is pressed once, the writing lead moves to cause the tip thereof to be exposed to the outside of a cap fixed on the bottom of the outer shell and if the pressing member is re-pressed, the writing lead moves to cause the tip thereof to be drawn to the cap.

In the conventional knock-type writing utensil, also, a spring is installed to apply a force to the opposite direction of the tip of the writing lead, on the end of the lower portion of the writing lead. Further, a knocking part is installed to maintain the moving state of the writing lead, if the pressing member is pressed once and to return the writing lead to the original position, if the pressing member is re-pressed.

However, the conventional knock-type writing utensil suffers a problem that in the case where a user keeps the writing utensil in the state where the hook of a clip formed on the top portion of the outer shell is stuck in the pocket on the clothes such as suits, shirts and the like, without any insertion of the tip of the writing lead into the cap fixed on the outer shell by the re-operation of the knock part during the writing, the tip comes in contact with the cloth of the clothes, such that the clothes are contaminated or stained due to the leakage of ink from the tip of the writing lead.

To solve the problem, recently, there is proposed a safety knock-type writing utensil capable of automatically inserting the tip of the writing lead into the cap fixed in the outer shell, if the hook of the clip fixed on the top portion of the outer shell is lifted, in case of sticking the writing utensil in the collar of a coat or the upper strip of a pocket.

However, the conventionally proposed safety knock-type writing utensil should essentially insert the part components for a safety knock between the outer shell and the writing lead, such that there occur some problems that the inside diameter of the outer shell is enlarged, the appearance thereof is degraded, and the using method thereof is complicated.

In addition, the safety knock is mounted on the end portion of the hook of the clip and the part components for the safety knock are necessarily installed, such that there occur some problems that the length of the writing lead is shortened, resulting in the decrement of the amount of ink stored therein and the deterioration of the efficiency of the writing utensil itself.

Therefore, in order to compensate for the reduced amount of ink, the thickness of the writing lead should increase, but in this case, there exists a problem that a sealing material for preventing the reverse flowing of the ink at the interior of the writing lead becomes push backward due to the reduction of the surface tension by the increment of the thickness of the writing lead.

SUMMARY OF THE INVENTION

It is, therefore, an object of the present invention to provide a safety knock-type writing utensil capable of providing a safety protrusion which extrudes on a moving member fixed on the interior of an outer shell and a safety hole which is formed in a length direction of the outer shell, whereby it can provide an advantage that the length of a writing lead is enlarged, while maintaining the outer shell in a relatively thin thickness.

To attain this and other objects of the present invention, there is provided a novel safety knock-type writing utensil including: an outer shell being of a predetermined shape and having a moving groove formed in a predetermined length in a length direction thereof from the upper portion thereof; a clip assembled on the end portion of the outer shell and having a long hook in the length direction of the outer shell at the one side thereof, the hook having a locking projection extruding in the center direction of the outer shell at the end portion thereof; a writing lead inserted into the interior of the outer shell and having ink stored in the interior thereof and a tip on the end of the one side thereof where writing is conducted; an elastic member installed in the interior of the outer shell, for applying a force in an opposite direction of the tip against the writing lead; a moving member movably inserted in the top portion of the outer shell and having a predetermined length of safety protrusion inserted into the interior of the moving groove in a length direction thereof, the safety protrusion having a fixed projection extruding outwardly to be locked on the locking projection of the clip; a pressing member having a pressing protrusion inserted movably into the interior of the moving member at the part of the lower portion thereof and being contacted with the upper surface of the moving member at the outer peripheral surface of the center portion thereof; and a knock member inserted movably into the moving member, for maintaining the advanced state of the writing lead if the pressing member is pressed once in the state where the fixed projection of the moving member is locked into the locking projection of the clip, and for operating the writing lead in a backward direction by the elastic force of the elastic member if the pressing member is repressed.

The moving member comprises: a cylindrical moving body provided with one or more guide grooves and guide projections formed in turn along the inner peripheral surface thereof, each of the guide grooves forming a return preventing projection extruding in a lower height than the guide projection in a skipping manner over one guide groove; the safety protrusion extending from the one side of the moving body, formed in a predetermined length in the length direction of the outer shell, and inserted movably into the moving groove of the outer shell; and the fixed projection extruding in a predetermined length in the center direction of the outer shell, on the lower portion of the safety protrusion.

The pressing member comprises: the pressing protrusion extruding along the circumferential direction at the center portion in a length direction of the outer peripheral surface thereof and being in contact with the upper surface of the moving body of the moving member; one or more moving projections extruding at predetermined intervals on the end of the outer peripheral surface of the lower portion of the pressing protrusion, inserted movably into the guide grooves of the moving member and having a height adapted to prevent the locking to the return preventing projections; and a plurality of teeth formed on the end surface of the bottom side thereof.

The knock member comprises one or more knock projections extruding at intervals of second times the guide grooves of the moving member along the circumference on the outer peripheral surface thereof, inserted movably into the guide grooves of the moving member and having a height adapted to be locked to the return preventing projections. Each of the knock projections forms an inclined surface corresponding to the tooth of the pressing member on the upper surface thereof.

The clip comprises: a stopper assembled on the end portion of the outer shell and having a hole into which the upper side of the pressing protrusion is inserted movably, on the center portion thereof; the hook extending from the one side of the stopper and formed in a predetermined length in the length direction of the outer shell; and the locking projection protrudedly formed in the center direction of the outer shell from the lower portion of the hook, into which the fixed projection of the moving member is locked.

DETAILED DESCRIPTION OF THE PREFERRED EMBODIMENT

Now, an explanation of a construction of a safety knock-type writing utensil according to a first embodiment of the present invention will be hereinafter discussed with reference to FIGS. 1 to 3.

Figure 2:
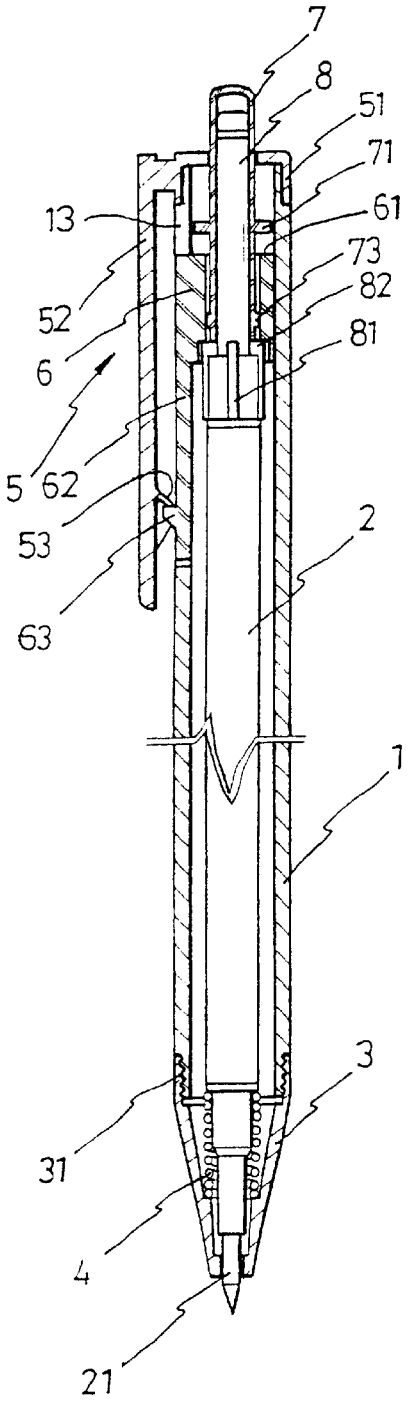
FIG. 2 is a schematically sectional view illustrating a writing state of the safety knock-type writing utensil of FIG. 1.
Figure 3:
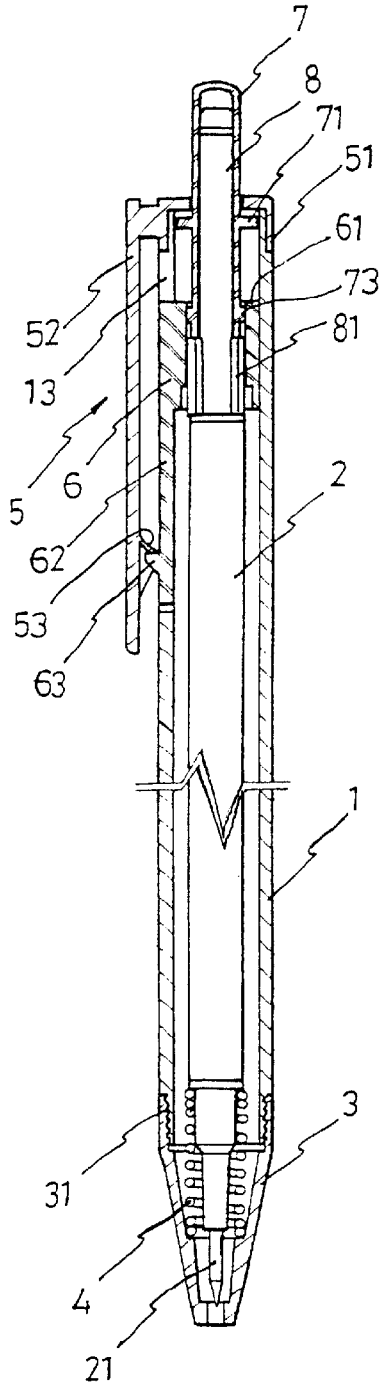
FIG. 3 is a schematically sectional view illustrating a writing release state of the safety knock-type writing utensil of FIG. 1.

As shown, first, the safety knock-type writing utensil according to the first embodiment of the present invention includes: an outer shell 1 being of a predetermined shape; a writing lead 2 adapted to be inserted into the interior of the outer shell 1; a cap 3 adapted to be assembled on the end portion of the outer shell 1; an elastic member installed between the cap 3 and the writing lead 2, for applying a force in an opposite direction of the cap 3 against the writing lead 2; a clip 5 adapted to be assembled on the outer shell 1 on the opposite side of the cap 3; a pressing member 7 adapted to be inserted movably into the outer shell 1 in a length direction on the opposite side of the cap 3; a moving member 6 adapted to be inserted movably into the outer shell 1 and installed between the pressing member 7 and the writing lead 2; and a knock member 8 adapted to be inserted movably into the outer shell 1 in the length direction by means of the moving member 6, for maintaining a writing state where a tip 21 of the writing lead 2 is exposed to the outside if the pressing member 7 advances to the cap 3 once (See FIG. 2), and for operating a writing release state where the tip 21 of the writing lead 2 is completely inserted into the interior of the cap 3 by means of the elastic force of the elastic member 4 if the pressing member 7 advances to the cap 3 two times (See FIG. 3).

The writing lead 2 stores ink in the interior thereof and has the tip 21 on which the writing operation is carried out on the end of the one side thereof, the tip 21 being adapted to be assembled rotatably with a ball on the end thereof.

The outer shell 1 is provided with an assembling part 11 to which the clip 5 is coupled on the top portion thereof, the assembling part 11 having a smaller section than the outer shell 1, and a male screw 12 to which the cap 3 is coupled on the end portion of the opposite side thereof.

In addition, the outer shell 1 is provided with a moving groove 13 formed in a predetermined length in the length direction thereof from the assembling part 11.

The cap 3, which is assembled to the male screw 12 formed on the lower portion of the outer shell 1, is a substantially conical shape and has a female screw 31 into which the male screw 12 is assembled. Also, the tip 21 of the writing lead 2, which is inserted movably into the interior of the outer shell in the length direction thereof, is positioned in the interior of the conical cap 3.

The preferred embodiment of the present invention describes the assembly of the cap 3 with the outer shell 1 by means of the female screw 31 and the male screw 12, but may assemble the top of the cap 3 with the lower portion of the outer shell 1 in a fitting manner, or may assemble one or more protrusion or a taper surface formed on the top of the cap 3 with the outer shell 1 for the perfect assembling state.

The elastic member 4, which is inserted between the cap 3 and the writing lead 2, preferably uses a compression coil spring.

Figure 1:
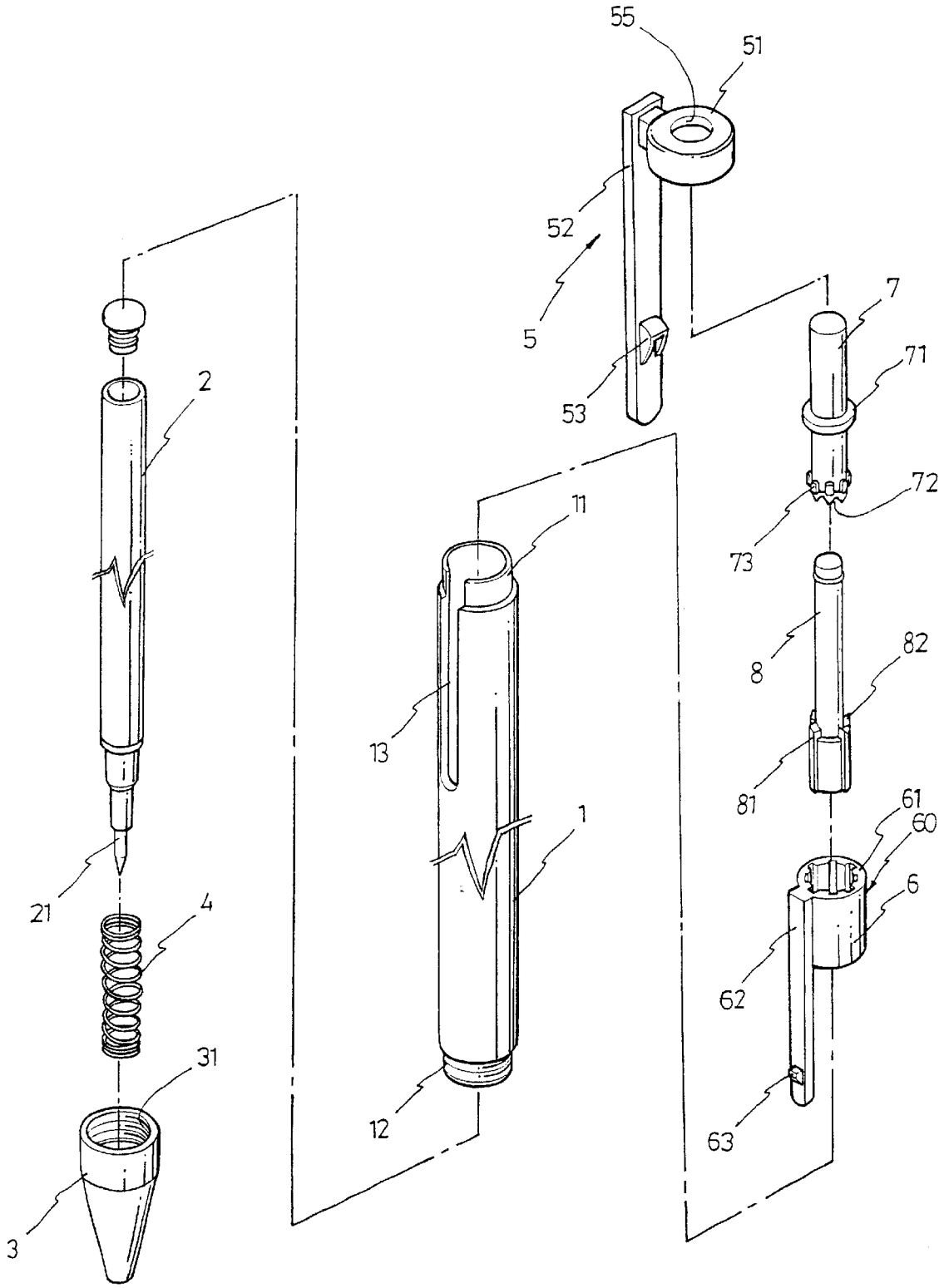
FIG. 1 is a schematically exploded perspective view illustrating a safety knock-type writing utensil according to a first embodiment of the present invention.
Figure 5:
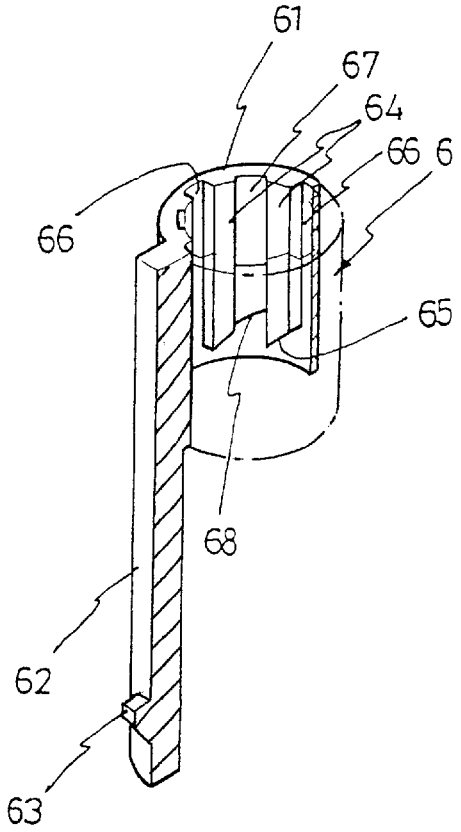
FIG. 5 is a schematically perspective and sectional view illustrating an embodiment of the moving member of FIG. 1.

The clip 5, as shown in FIGS. 1 and 5, comprises a stopper 51 assembled on the assembling part 11 of the outer shell 1 and a hole 55 into which the pressing member 7 is inserted movably on the center of the upper portion of the stopper 5 1.

In addition, the clip 5 is provided with a hook 52 extending from the one side of the stopper 51 and formed in a predetermined length in the length direction of the outer shell 1, for the purpose of being stuck on the collar of a coat or the upper strip of a pocket.

The preferred embodiment of the present invention describes the assembly and fixing of the clip 5 with the assembling part 11 of the top portion of the outer shell 1, but may assemble the clip 5 with the assembling part 11 by the formation of one or more protrusion or a taper surface for the perfect assembling state or may assemble the clip 5 with the assembling part 11 by the formation of the female and male screws.

The pressing member 7, as shown in FIGS. 1 to 3, is provided with a pressing protrusion 71 extruding on the outer peripheral surface of the center portion thereof in a length direction and being in contact with the upper surface 61 of the moving member 6 and/or the stopper 51 of the clip 5.

The pressing protrusion 71 is adapted to be in contact with the upper surface 61 of the moving member 6 on the lower surface thereof and with the stopper 51 of the clip 5 on the upper surface thereof.

The formation of the pressing protrusion 71 on the pressing member 7 prevents the pressing member 7 from being deviated to the outside of the outer shell 1 by the elastic force of the elastic member 4 delivered through the writing lead 2 and the moving member 6.

In other words, as the pressing protrusion 71 is locked to the stopper 51, when the writing lead 2 moves upward, the deviation of the pressing member 7 to the outside of the outer shell 1 after the passing of the hole 55 of the stopper 51 can be prevented.

It is preferred that the upper end portion of the pressing member 7 is a curved surface in order to make the appearance thereof more beautiful and prevent the damage on the hand of a user upon pressing.

The moving member 6, as shown in FIGS. 1 and 5, is provided with a moving body 60 of a cylindrical shape and a safety protrusion 62 extending in a predetermined length from the one side of the moving body 60 to the length direction of the outer shell 1.

The moving member 6 has the same thickness as the writing lead 2 or has a diameter that allows the size of the outer shell 1 to be enlarged.

The safety protrusion 62 is inserted movably into the moving groove 13 of the outer shell 1.

The moving member 6 is provided with a fixed projection 63 extruding to the outside (toward the hook 52 of the clip 5) on the end of the lower portion of the safety protrusion 62. On the other hand, the clip 5 is provided with a locking projection 53 extruding in the center direction (inside) of the outer shell 1 on the end of the lower portion of the hook 52, into which the fixed projection 63 is locked.

The moving body 60 of the moving member 6, as shown in FIG. 5, includes one or guide grooves 66 and guide projections 64 formed in turn along the circumference of the inner peripheral surface thereof. The guide grooves 66 are provided with return preventing projections 67 extruding in a lower height than the guide projections 64 in a skipping manner over the one guide groove 66.

Figure 7:
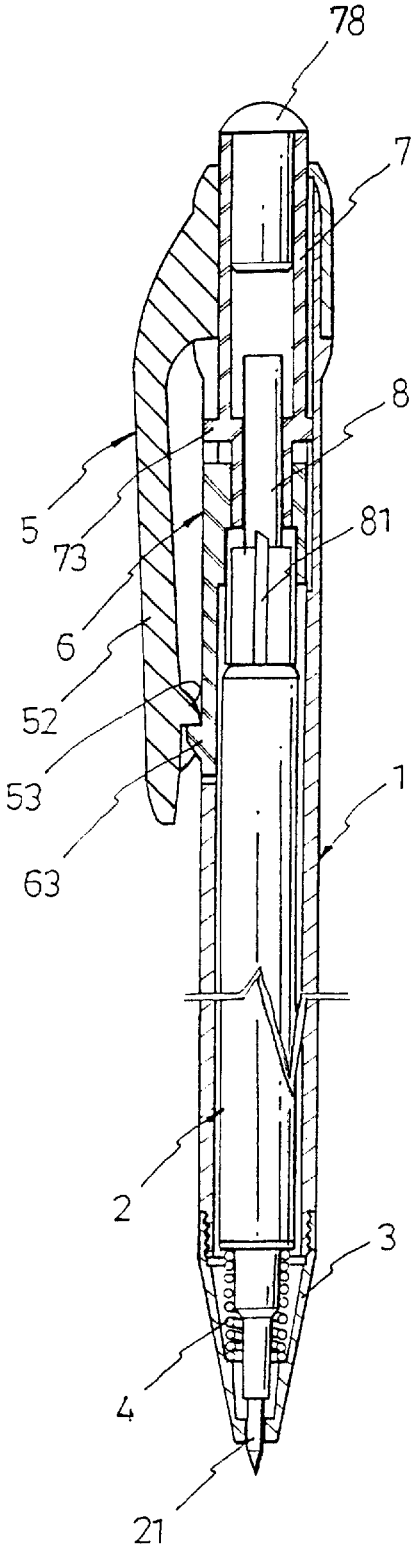
FIG. 7 is a schematically sectional view illustrating a writing state of the safety knock-type writing utensil of FIG. 2.

The pressing member 7, as shown in FIG. 7, includes one or more moving projections 73 extruding on the outer peripheral surface of the end of the lower portion thereof at predetermined intervals along the circumference thereof, inserted movably into the guide grooves 66 of the moving member 6, and having a height that is set not to be locked to the return preventing projections 67.

Further, the pressing member 7 is provided with a plurality of teeth 72 on the end of the lower portion thereof.

The knock member 8, as shown in FIG. 1, includes one or more knock projections 81 extruding at intervals of second times the guide grooves 66 of the moving member 6 along the circumference on the outer peripheral surface thereof, inserted movably into the guide grooves 66 of the moving member 6 and having a height set to be locked to the return preventing projections 67.

The upper surface of each of the knock projections 81 is an inclined surface corresponding to the tooth 72 of the pressing member 7.

The end surface of the lower portion of each of the guide projections 64 and the end surface of the lower portion of each of the return preventing projections 67 are an inclined surface on which each of the knock projection 81 smoothly rotates and moves.

When the teeth 72 of the pressing member 7 are assembled with the knock projections 81 of the knock member 8 and the guide grooves 66 and the guide projections 64 of the moving member 6, respectively, a force is applied in such a manner that the knock member 8 is positioned to rotate in one side direction thereof.

In other words, in the state where the elastic force of the elastic member 4 is exerted, the reentrant vertical point of each of the teeth 72 is positioned to conflict with the vertical point of the inclined surface 82 of each of the knock projections 81.

By the above-mentioned formation, the inclined surface 82 and the tooth 72 slidingly move when the elastic force of the elastic member 4 is exerted, but since the moving projections 73 of the pressing member 7 are inserted into the guide grooves 66 to cause the rotation of the pressing member 7 to stop, such that the rotation force is applied to the knock member 8.

The pressing member 7 is of a hollow cylinder shape, into which the part of the knock member 8 is inserted.

Next, an explanation of the operation of the safety knock-type writing utensil according to the first embodiment of the present invention will be discussed.

Figure 4:
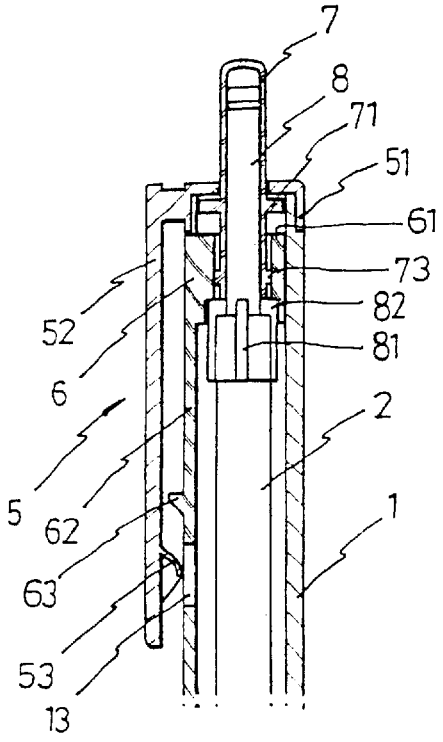
FIG. 4 is a schematically sectional view illustrating a keeping state of the safety knock-type writing utensil of FIG. 1.

In the keeping state as shown in FIG. 4, if the pressing member 7 is pressed for the writing operation by a user, the moving member 6, which is in contact with the pressing protrusion 71 of the pressing member 7 on the upper surface thereof and the knock member, which is inserted into the pressing member 7 on the upper portion thereof, move downward.

By the advancement of the moving member 6, if the fixed projection 63 moves downward over the locking projection 53 of the hook 52 of the clip 5, the fixed projection 63 passes the locking projection 53. Thus, even if the force applied to the pressing member 7 is removed, the fixed projection 63 is locked to the locking projection 53, which prevents the moving member 6 from being returned upward.

If the force applied to the pressing member 7 has been removed, the writing lead 2 moves backward and upward by the elastic force of the elastic member 4, and the knock member 8 and the pressing member 7, which are in contact with the upper surface of the writing lead 2, move backward, such that a writing release state where the tip 21 of the writing lead 2 is completely inserted into the inside of the cap 3 is maintained (See FIG. 3).

At this time, the moving projections 73 of the pressing member 7 are inserted into the guide grooves 66 of the moving member 6, with a consequence that the pressing member 7 moves forward and backward in the length direction of the outer shell 1 along the guide grooves 66.

Additionally, the knock projections 81 of the knock member 8 are inserted into the guide grooves 66 of the moving member 6 where the return preventing projections 67 are not formed, with a consequence that the knock member 8 moves forward and backward in the length direction of the outer shell 1 along the guide grooves 66.

Under the writing release state, if the pressing member 7 is pressed once by the user, the knock member 8, which is in contact with the pressing member 7, moves downward and thus, the writing lead 2 moves to the cap 3 by overwhelming the elastic force of the elastic member 4, with a consequence that the tip 21 of the writing lead 2 is exposed to the outside of the cap 3.

If the inclined surface 82 as the end surface of the upper portion of each of the knock projections 81 of the knock member 8 is positioned downward over the inclined surfaces 65 and 68 of each of the guide projections 64 and each of the return preventing projections 67 of the moving member 6 (if the knock projections 81 of the knock member 8 are deviated downward from the guide grooves 66), the knock member 8 rotates, resulting in the engagement of the vertical point of the inclined surface 82 of each of the knock projections 81 of the knock member 8 with the vertical point of the tooth 72 of the pressing member 7.

Under the above state, if the force applied to the pressing member 7 is removed, the knock member 8 moves backward by the elastic force of the elastic member 4 delivered through the writing lead 2, but as the knock member 8 is locked to the return preventing projections 67 of the moving member 6, it is not really restricted in movement. The moving member 6 does not really move as the fixed projection 63 is locked to the locking projection 53 of the clip 5, such that a writing state where the tip 21 of the writing lead 2 is exposed to the outside of the cap 3 is maintained (See FIG. 2).

At this time, the pressing member 7 can be in a freely upward and downward movable state between the knock member 8 and the stopper 51 of the clip 5, as the moving projections 73 are not locked to the return preventing projections 67.

Under the above writing state, if the pressing member 7 is re-pressed for keeping of the writing utensil after the writing operation, the knock member 8 moves forward and thus, the knock projections 81 are deviated from the state closely contacted with the return preventing projections 67.

At this time, the knock member 8 re-rotates such that the knock projections 81 pass the guide projections 64 and are positioned on the guide grooves 66 where the return preventing projections 67 are not formed.

Under the above state, if the force applied to the pressing member 7 is removed, the writing lead 2 moves backward by the elastic force of the elastic member 4 and sequentially, the knock member 8 and the pressing member 7 move backward, with a result that the writing state is changed to the writing release state (the tip 21 of the writing lead 2 is completely inserted into the inside of the cap 3) (See FIG. 3).

At this time, as the knock projections 81 are positioned on the guide grooves 66 where the return preventing projections 67 are not formed, the knock member 8 moves backward in a smooth manner.

According to the repetitive pressing of the pressing member 7 once and twice, the writing state and the writing release state are repeatedly changed.

During the writing in the writing state, if the hook 52 of the clip 5 is lifted toward the direction distant from the outer shell 1 for the purpose of sticking the writing utensil on the collar of a cloth or the upper strip of a pocket in the state where the pressing member 7 is not pressed again for the change to the writing release state, the fixed projection 63 is deviated from the locked state to the locking projection 53 and the knock member 8 moves backward by the elastic force of the elastic member 4. Since the knock projections 61 of the moving member 6 are locked to the return preventing projections 67, the moving member 6 moves along the knock member 8, such that the tip 21 of the writing lead 2 is completely inserted into the inside of the cap 3 (See FIG. 4).

Next, an explanation of the construction of the safety knock-type writing utensil according to a second embodiment of the present invention will be discussed with reference to FIGS. 6 and 8.

As shown, the pressing member 7 comprises: a pressing body 70 of a cylindrical shape; an insertion part 74 adapted to be connected to the pressing body 70, while intervening a pressing protrusion 75 which is in contact with the upper surface of the moving member 6 therebetween and inserted into the moving member 6; a plurality of teeth 72 formed on the end of the bottom side of the insertion part 74; and a moving projection 73 adapted to be inserted movably in a length direction into the moving groove 13 formed in the outer shell 1.

The pressing member 7 is assembled with the outer shell 1, while being restricted upon rotation thereof by the movable insertion of the moving projection 73 into the moving groove 13.

The pressing member 7 further comprises a cover 78 assembled on the upper side of the pressing body 70 and forming a curved surface on the top surface thereof in order to make the appearance thereof more beautiful and prevent the damage on the hand of a user upon pressing.

Figure 6:
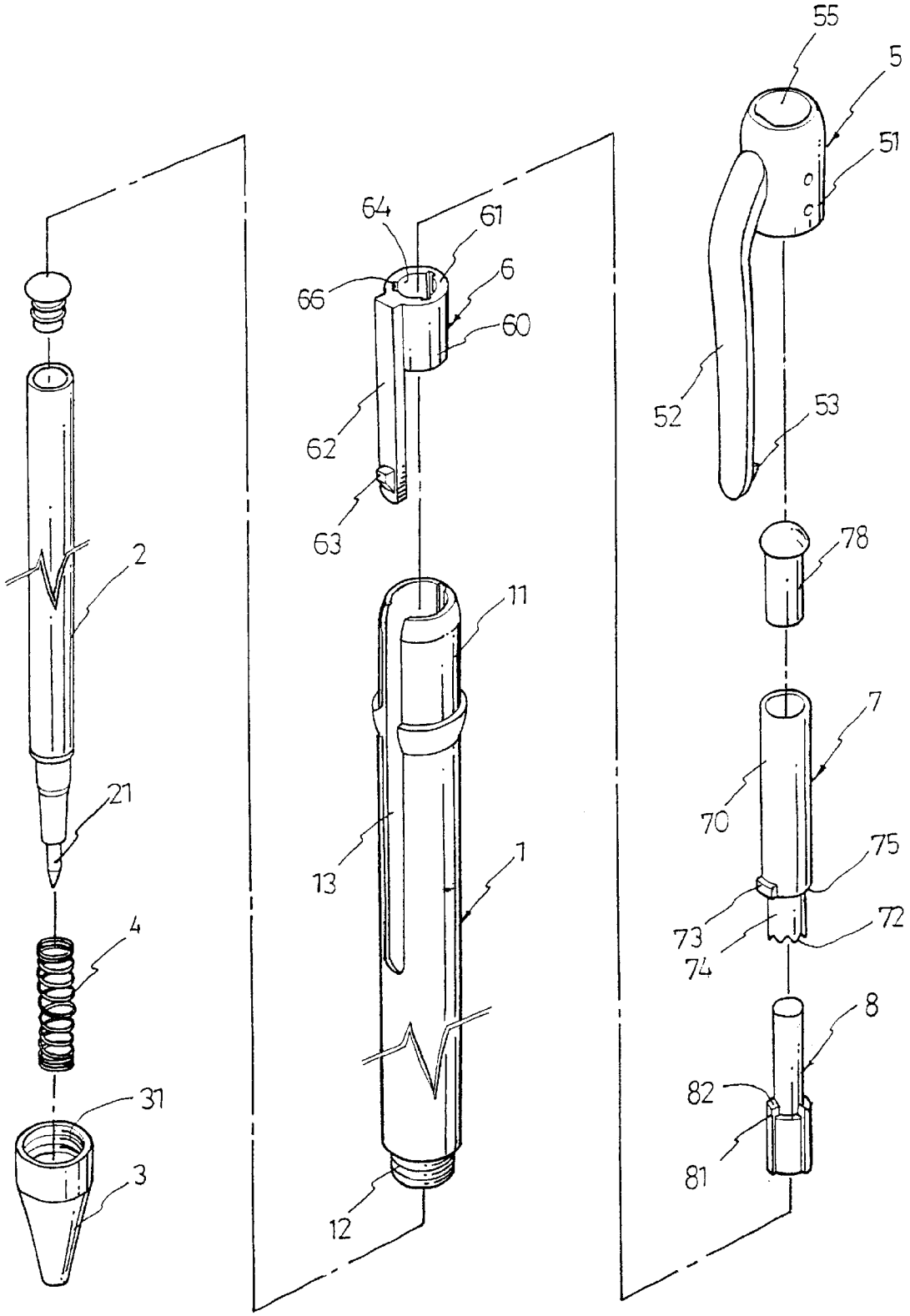
FIG. 6 is a schematically exploded perspective view illustrating a safety knock-type writing utensil according to a second embodiment of the present invention.
Figure 8:
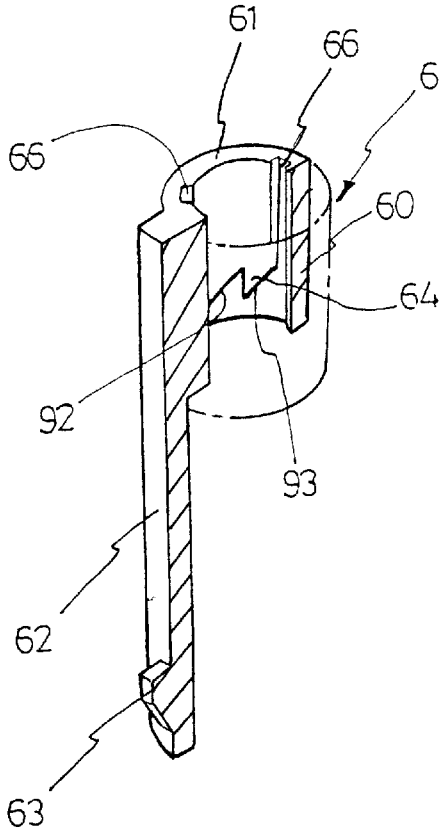
FIG. 8 is a schematically perspective and sectional view illustrating another embodiment of the moving member of FIG. 2.

As shown in FIGS. 6 to 8, the moving member 6 comprises: a cylindrical moving body 60; a safety protrusion 62 extending in a predetermined length from the one side of the moving body 60 in the length direction of the outer shell 1 and inserted movably into the moving groove 13 of the outer shell 1; and a fixed projection 63 extruding to the outside (to the hook 52 of the clip 5) on the end of the lower portion of the safety protrusion 62 and locked to the hook 52 of the clip 5.

The moving body 60 of the moving member 6, as shown in FIG. 8, includes one or guide grooves 66 and guide projections 64 formed in turn along the circumference of the inner peripheral surface thereof. Each of the guide projections 64 is provided with a return preventing part 92 as an inclined surface connected to each of the guide grooves 66 at the sharp end portion thereof and a return guide part 93 as an inclined surface forming a reentrant vertical point on the one side thereof to be connected to the return preventing part 92 and connected to each of the guide grooves 66 on the other side thereof, on the end surface of the bottom portion thereof.

The return preventing part 92 and the return guide part 93 are in contact with the inclined surface 82 as the upper surface of each of the knock projections 81.

The safety knock-type writing utensil according to the second embodiment of the present invention has the same entire configuration as in the first embodiment of the present invention except the above-mentioned construction, a detailed explanation of which will be avoided for the brevity of the description.

In operation, if the pressing member 7 is pressed by the user in the state of FIG. 4, the moving member 6, which is in contact with the pressing protrusion 75 of the pressing member 7, on the upper surface thereof, moves downward.

If the force applied once to the pressing member 7 is removed, the knock projections 81 are locked to the reentrant vertical points of the return preventing parts 92 of the moving member 6 and restricted upon rotation thereof, such that the writing state where the tip 21 of the writing lead 2 is exposed to the outside of the cap 3 is maintained (See FIG. 7).

Then, if the force applied two times to the pressing member 7 is removed, the knock projections 81 move along the return guide part 93 to advance to the guide grooves 66 and thereby, the writing lead 2 moves backward, such that the writing release state where the tip 21 of the writing lead 2 is completely inserted into the inside of the cap 3 is maintained (See FIG. 3).

The safety knock-type writing utensil according to the second embodiment of the present invention has the same operation as in the first embodiment of the present invention except the above-mentioned operation, a detailed explanation of which will be avoided for the brevity of the description.

According to the safety knock-type writing utensil of the present invention, if the hook of the clip is lifted and stuck on the upper strip of a pocket in the state where the tip of the writing lead is exposed to the outside of the cap, the tip of the writing lead is automatically inserted into the inside of the cap by the elastic force of the elastic member, thereby preventing the contamination and stain on the clothes of a user caused due to the leakage of the ink from the tip of the writing lead.

According to the safety knock-type writing utensil of the present invention, the safety protrusion of the moving member where the safety knock is conducted is inserted into the moving groove of the outer shell, such that the outer shell has a relatively thin thickness and thus exhibits a beautiful and sophisticated appearance.

According to the safety knock-type writing utensil of the present invention, the knock operation is carried out not on the end portion of the hook of the clip, but on the stopper of the clip, such that the writing lead has a relatively long length and thus increase an amount of ink stored therein, without any change of the thickness thereof.

The present invention should not be limited to the preferred embodiments described above, but may be modified in various forms without departing the spirit of the invention.

What is claimed is:

1. A safety knock-type writing utensil comprising:

an outer shell being of a predetermined shape and having a predetermined length of moving groove formed in a length direction thereof from the upper portion thereof;

a clip assembled on the end portion of said outer shell and having a long hook in the length direction of said outer shell at the one side thereof, said hook having a locking projection extruding in the center direction of said outer shell at the end portion thereof;

a writing lead inserted into the interior of said outer shell, and having ink stored in the interior thereof and a tip on the end of the one side thereof where writing is conducted;

an elastic member installed in the interior of said outer shell, for applying a force in an opposite direction of said tip against said writing lead;

a moving member movably inserted in the top portion of said outer shell and having a predetermined length of safety protrusion inserted into the interior of said moving groove in a length direction thereof, said safety protrusion having a fixed projection extruding outwardly to be locked on said locking projection of said clip;

a pressing member having a pressing protrusion inserted movably into the interior of said moving member at the lower portion thereof and being contacted with the upper surface of said moving member at the outer peripheral surface of the center portion thereof; and a knock member inserted movably into said moving member, for maintaining an advanced state of said writing lead if said pressing member is pressed once in the state where said fixed projection of said moving member is locked into said locking projection of said clip, and for operating said writing lead in a backward direction by the elastic force of said elastic member if said pressing member is pressed two times.

2. The safety knock-type writing utensil of claim 1, wherein said moving member comprises: a cylindrical moving body provided with one or more guide grooves and guide projections formed in turn along the inner peripheral surface thereof, each of said guide grooves forming a return preventing projection extruding in a lower height than each of said guide projections in a skipping manner over one guide groove; said safety protrusion extending from the one side of said moving body, formed in a predetermined length in the length direction of said outer shell, and inserted movably into said moving groove of said outer shell; and said fixed projection extruding in a predetermined length in the center direction of said outer shell, on the lower portion of said safety protrusion, said guide projections and said return preventing projections formed on said moving body each having an inclined surface on the end surface of the bottom portion thereof.

3. The safety knock-type writing utensil of claim 2, wherein said pressing member comprises: said pressing protrusion extruding along the circumferential direction at the center portion in a length direction of the outer peripheral surface thereof and being in contact with the upper surface of said moving body of said moving member; one or more moving projections extruding at predetermined intervals on the end of the outer peripheral surface of the lower portion of said pressing protrusion, inserted movably into said guide grooves of said moving member and having a height adapted to prevent the locking to said return preventing projections;

and a plurality of teeth formed on the end surface of the bottom side thereof.

4. The safety knock-type writing utensil of claim 3, wherein said knock member comprises one or more knock projections extruding at intervals of second times said guide grooves of said moving member along the circumference on the outer peripheral surface thereof, inserted movably into said guide grooves of said moving member and having a height adapted to be locked to said return preventing projections, each of said knock projections forming an inclined surface corresponding to said tooth of said pressing member on the upper surface thereof.

5. The safety knock-type writing utensil of claim 2, wherein said clip comprises: a stopper assembled on the end portion of said outer shell and having a hole into which the upper side of said pressing protrusion is inserted movably, on the center portion thereof; said hook extending from the one side of said stopper and formed in a predetermined length in the length direction of said outer shell; and said locking projection extruding in the center direction of said outer shell from the lower portion of said hook, into which said fixed projection of said moving member is locked.

6. The safety knock-type writing utensil of claim 1, wherein said moving member comprises: a cylindrical moving body, a safety protrusion extending in a predetermined length from the one side of said moving body in the length direction of said outer shell and adapted to be inserted movably into said moving groove of said outer shell, and a fixed projection extruding to the outside on the end of the lower portion of said safety protrusion and locked to said hook of said clip, and said moving body comprises one or more guide grooves and guide projections formed in turn along the circumference of the inner peripheral surface thereof, each of said guide projections being provided with a return preventing part as an inclined surface connected to each of said guide grooves at a sharp end portion thereof and a return guide part as an inclined surface forming a reentrant vertical point on the one side thereof to be connected to said return preventing part and connected to each of said guide grooves on the other side thereof, on the end surface of the bottom portion thereof.

7. The safety knock-type writing utensil of claim 1, wherein said pressing member comprises a pressing body of a cylindrical shape, an insertion part adapted to be connected to said pressing body, while intervening a pressing protrusion which is in contact with the upper surface of said moving member therebetween and inserted into said moving member, a plurality of teeth formed on the end of the bottom side of said insertion part, a moving projection extruding to the outside on the one side of the outer peripheral surface of said pressing body and inserted movably in a length direction into said moving groove formed in said outer shell, and a cover assembled on the upper side of said pressing body and having a curved surface on the top surface thereof.

* * * * *